US008967576B2

(12) United States Patent
Knoll et al.

(10) Patent No.: US 8,967,576 B2
(45) Date of Patent: Mar. 3, 2015

(54) ASSEMBLY FOR A STORAGE UNIT

(75) Inventors: Mitchell Knoll, Eagan, MN (US); David J. Floersch, Minneapolis, MN (US); Andrew G. Lozier, Omaha, NE (US)

(73) Assignee: Target Brands, Inc., Minneapolis, MN (US)

( * ) Notice: Subject to any disclaimer, the term of this patent is extended or adjusted under 35 U.S.C. 154(b) by 61 days.

(21) Appl. No.: 13/561,223

(22) Filed: Jul. 30, 2012

(65) Prior Publication Data

US 2014/0027397 A1 Jan. 30, 2014

(51) Int. Cl.

| | |
|---|---|
| ***A47B 95/00*** | (2006.01) |
| *A47B 43/00* | (2006.01) |
| *A47B 47/00* | (2006.01) |

(52) U.S. Cl.

USPC ..... 248/345.1; 211/186; 211/189

(58) Field of Classification Search

CPC ..... A47B 47/00

USPC ..... 211/189, 182, 183, 186, 204, 206; 312/278, 265.5, 265.6; 52/173.2, 831, 52/716.1, 36.4, 36.5, 242, 718.04, 717.06; 248/345.1

See application file for complete search history.

(56) References Cited

U.S. PATENT DOCUMENTS

| | | | | | |
|---|---|---|---|---|---|
| 1,376,203 | A | | 4/1921 | Himes | |
| 1,426,277 | A | * | 8/1922 | Conant | 52/717.06 |
| 2,051,531 | A | * | 8/1936 | Roberts | 49/460 |
| 2,166,889 | A | * | 7/1939 | Churchill | 52/718.04 |
| 2,297,887 | A | * | 10/1942 | Hall et al. | 52/718.04 |
| 2,500,377 | A | * | 3/1950 | Poupitch | 24/295 |
| 2,965,243 | A | * | 12/1960 | Mapson | 211/183 |
| 2,997,141 | A | * | 8/1961 | Wetzler | 52/836 |
| 3,081,718 | A | * | 3/1963 | Shoffner | 108/108 |
| 3,101,681 | A | * | 8/1963 | Streater | 108/28 |
| 3,209,709 | A | * | 10/1965 | Shoffner | 108/27 |
| 3,237,964 | A | * | 3/1966 | Doyle | 280/164.1 |
| 3,263,821 | A | * | 8/1966 | Klene et al. | 211/190 |
| 3,347,609 | A | * | 10/1967 | Mann | 312/263 |
| 3,587,867 | A | * | 6/1971 | Fenwick | 211/183 |

(Continued)

FOREIGN PATENT DOCUMENTS

| | | |
|---|---|---|
| CA | 1043298 | 11/1978 |
| CA | 1178558 | 11/1984 |

(Continued)

OTHER PUBLICATIONS

Office Action from Canadian Patent Application No. 2,790,103, mailed Mar. 14, 2013 (3 pages).

(Continued)

*Primary Examiner* — Joshua J Michener
*Assistant Examiner* — Devin Barnett
(74) *Attorney, Agent, or Firm* — Leanne Taveggia Farrell; Westman, Champlin & Koehler, P.A.

(57) ABSTRACT

An assembly for a storage unit includes at least one interior component made of a single, continuous piece of sheet material that has a first surface, an opposing second surface, a pair of opposing lateral side edges and a plurality of substantially 90 degree longitudinal bends that extend between the pair of lateral side edges. The at least one interior component includes an upper mounting flange for mounting to the storage unit. The assembly also includes an exterior component made of a single, continuous piece of sheet material and having a first surface and an opposing second surface. The first surface of the interior component directly attaches to the second surface of the exterior component.

14 Claims, 12 Drawing Sheets

(56) References Cited

U.S. PATENT DOCUMENTS

| | | | | | |
|---|---|---|---|---|---|
| 3,593,473 | A | * | 7/1971 | King | 52/211 |
| 3,602,159 | A | * | 8/1971 | Marschak | 108/187 |
| 3,640,389 | A | * | 2/1972 | Snyder | 211/187 |
| 3,655,159 | A | | 4/1972 | Held, Jr. | |
| 3,698,567 | A | | 10/1972 | Fenwick | |
| 3,945,167 | A | * | 3/1976 | Wendt | 52/714 |
| 4,010,591 | A | * | 3/1977 | Gross | 52/846 |
| 4,055,285 | A | * | 10/1977 | Bott | 224/326 |
| 4,108,085 | A | * | 8/1978 | Shepherd et al. | 108/108 |
| 4,242,970 | A | | 1/1981 | Suttles et al. | |
| 4,290,660 | A | | 9/1981 | Brezosky | |
| 4,564,111 | A | * | 1/1986 | Suttles | 211/189 |
| 4,606,170 | A | * | 8/1986 | Mendenhall | 108/27 |
| 4,646,656 | A | * | 3/1987 | Marschak | 108/108 |
| 4,720,957 | A | * | 1/1988 | Madray | 52/846 |
| 4,744,475 | A | * | 5/1988 | St. Pierre | 211/134 |
| 4,838,004 | A | * | 6/1989 | Adell | 52/716.6 |
| 4,918,886 | A | * | 4/1990 | Benoit et al. | 174/497 |
| 5,022,541 | A | * | 6/1991 | White | 211/186 |
| 5,069,263 | A | | 12/1991 | Edwards | |
| 5,163,568 | A | * | 11/1992 | Laurendeau et al. | 211/187 |
| 5,349,909 | A | | 9/1994 | Smit et al. | |
| 5,415,301 | A | * | 5/1995 | Bruton et al. | 211/183 |
| 5,598,681 | A | * | 2/1997 | DiGianni | 52/717.05 |
| 5,613,747 | A | | 3/1997 | Becker et al. | |
| 5,647,687 | A | | 7/1997 | Robinson et al. | |
| D385,483 | S | | 10/1997 | Robinson et al. | |
| 5,685,116 | A | * | 11/1997 | Bradshaw et al. | 52/311.1 |
| 5,927,041 | A | * | 7/1999 | Sedlmeier et al. | 52/836 |
| 6,223,916 | B1 | * | 5/2001 | Enos | 211/187 |
| D481,619 | S | | 11/2003 | Hightower | |
| 6,840,591 | B2 | | 1/2005 | Wessel | |
| 6,865,853 | B2 | * | 3/2005 | Burken et al. | 52/239 |
| 7,296,387 | B2 | * | 11/2007 | Milu | 52/716.4 |
| 7,788,875 | B2 | * | 9/2010 | Wendt | 52/712 |
| 8,122,658 | B2 | * | 2/2012 | Sondermann | 52/288.1 |
| 8,276,345 | B2 | * | 10/2012 | Brady | 52/839 |
| 8,646,618 | B2 | * | 2/2014 | Peota et al. | 211/4 |
| 2004/0009035 | A1 | * | 1/2004 | Hightower | 403/403 |
| 2004/0168384 | A1 | * | 9/2004 | Wesolowska | 52/287.1 |
| 2007/0069534 | A1 | * | 3/2007 | Morrill et al. | 293/117 |
| 2007/0267375 | A1 | * | 11/2007 | Battaglia et al. | 211/189 |
| 2012/0102849 | A1 | * | 5/2012 | Shugart | 52/96 |
| 2012/0279162 | A1 | * | 11/2012 | Strickland et al. | 52/588.1 |
| 2013/0026321 | A1 | * | 1/2013 | Richardson et al. | 248/235 |
| 2013/0254044 | A1 | * | 9/2013 | Catoe | 705/16 |

FOREIGN PATENT DOCUMENTS

| | | |
|---|---|---|
| CA | 1185568 | 4/1985 |
| CA | 2013265 | 6/1994 |

OTHER PUBLICATIONS

Lozier product catalog, "Display Shelving—Islands, Walls, Components, Free Standing Displays," dated 2005, p. 2.

Office Action from Canadian Patent Application No. 2,790,103, mailed Aug. 16, 2013 (5 pages).

* cited by examiner

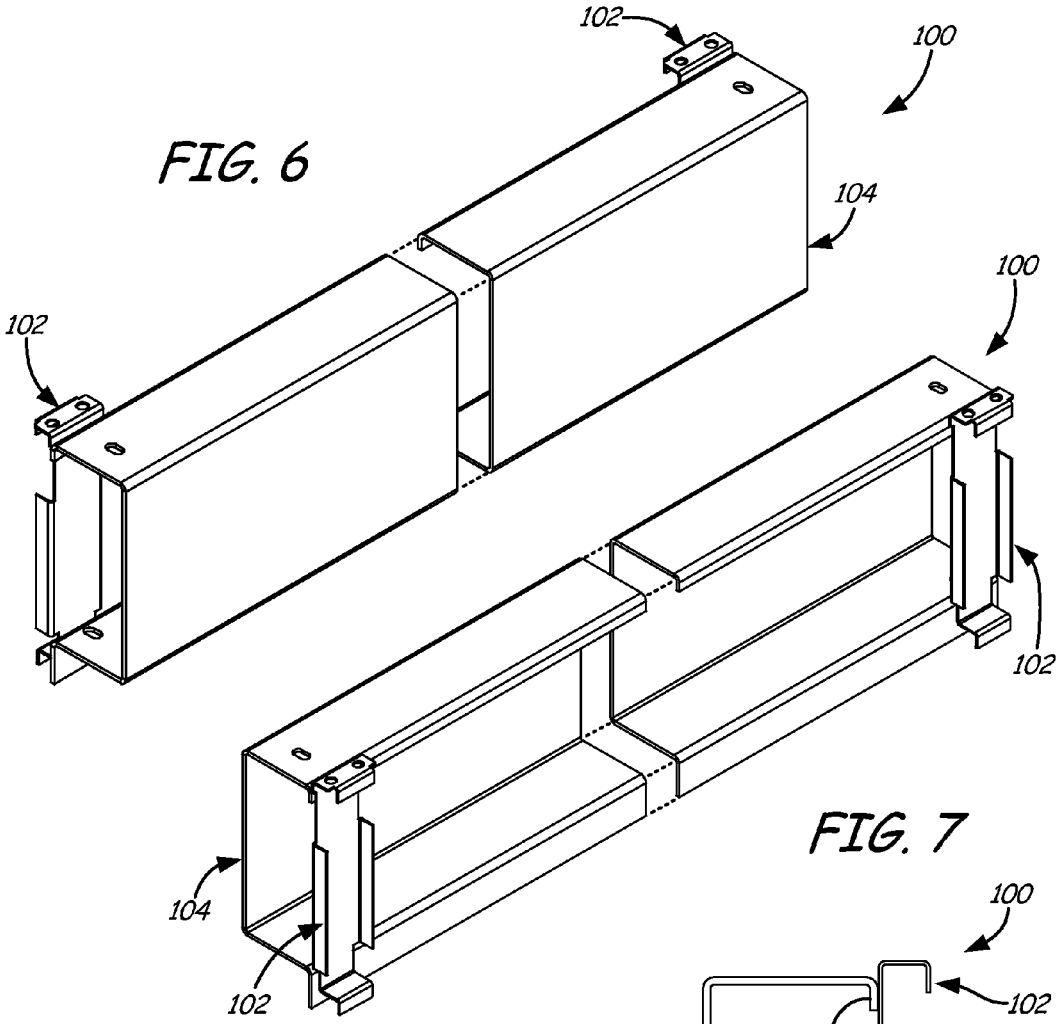
FIG. 6
FIG. 7
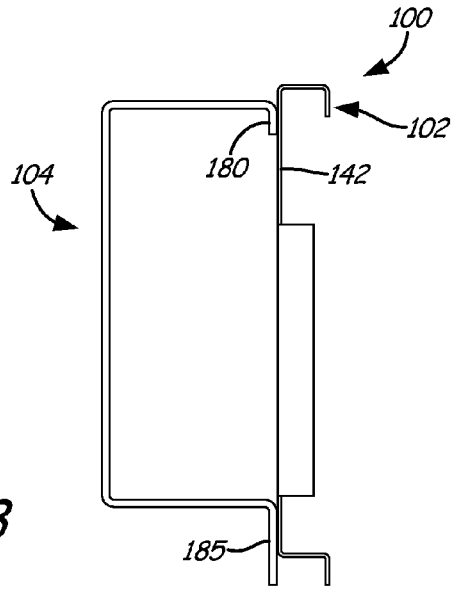
FIG. 8

FIG. 14
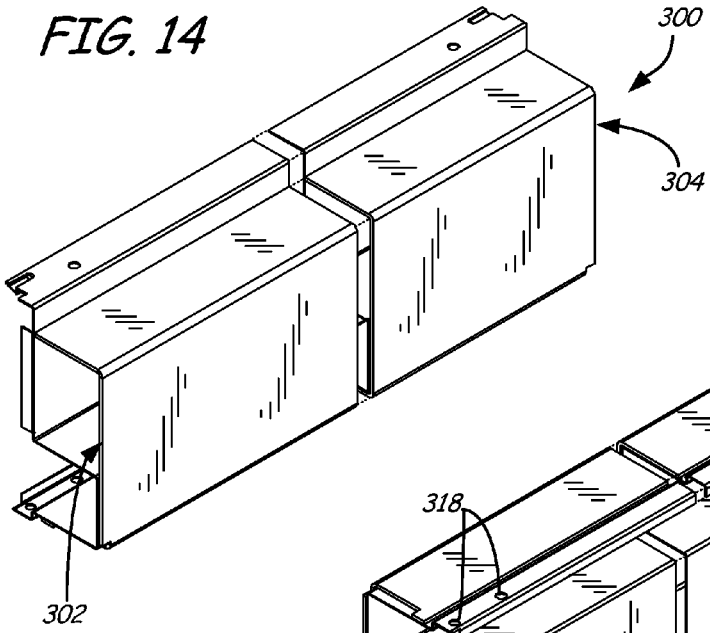
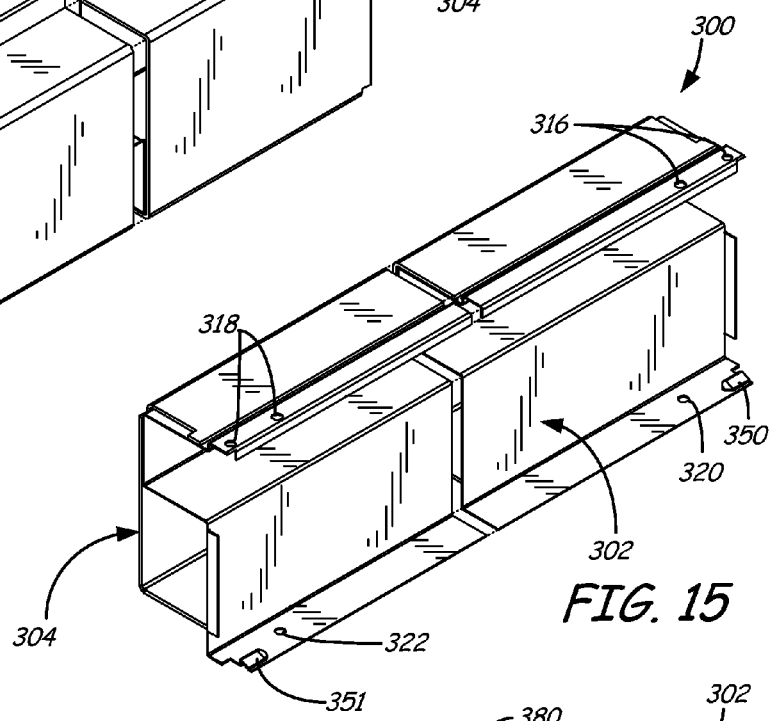
FIG. 15
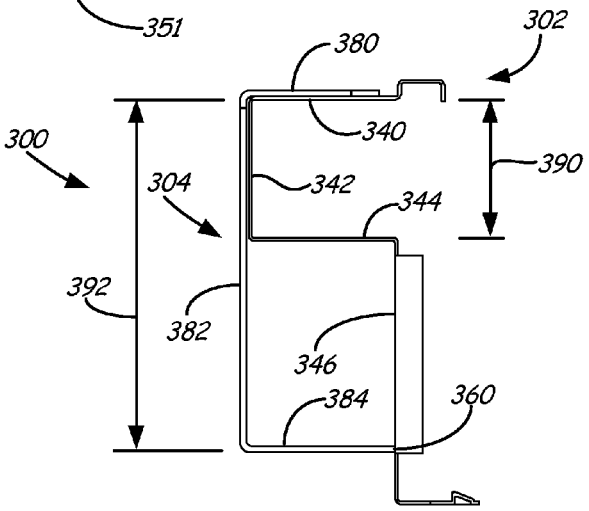
FIG. 16

FIG. 22
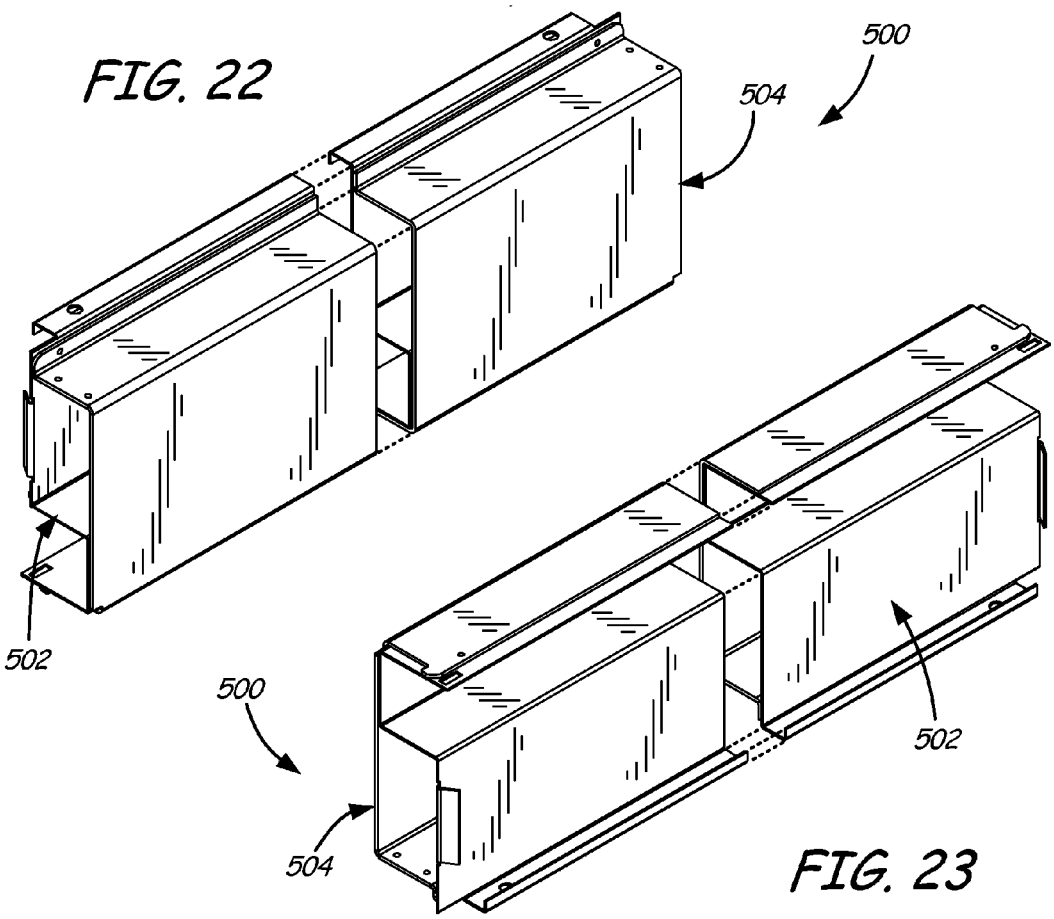
FIG. 23
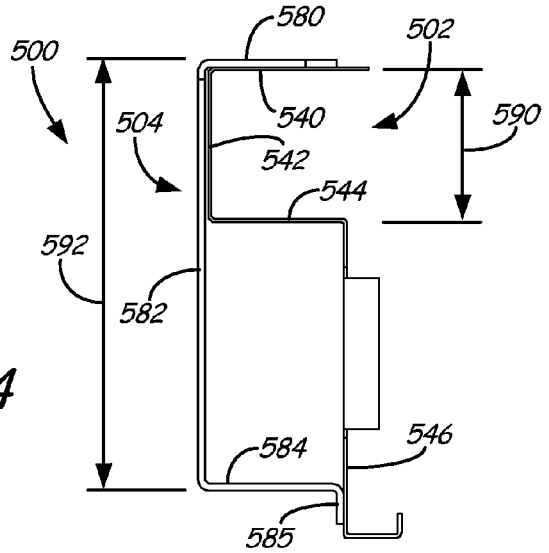
FIG. 24

ASSEMBLY FOR A STORAGE UNIT

BACKGROUND

A retail establishment uses various types of display units or shelving units to store, organize or present products to customers for purchase. One kind of display unit is a gondola. Gondola display units are constructed of, but are not limited to, uprights, back panels, base decks and kick plates. The gondola display units can both support products for display while simultaneously providing space for indicating the product price.

The discussion above is merely provided for general background information and is not intended to be used as an aid in determining the scope of the claimed subject matter.

SUMMARY

An assembly for a storage unit includes at least one inner skin component made of a first piece of bendable sheet material and including an upper longitudinal edge, a lower longitudinal edge and a pair of lateral side edges. The assembly also includes an outer skin made of a second piece of bendable sheet material and including an upper longitudinal edge, a lower longitudinal edge and a pair of lateral side edges.

The at least one inner skin component is formed by bending a plurality of longitudinal bends between the upper longitudinal edge and the lower longitudinal edge of the at least one inner skin component and extending them between the first lateral side edge and the second lateral side edge of the inner skin. Likewise, the outer skin is formed by bending a plurality of longitudinal bends between the upper longitudinal edge and the lower longitudinal edge of the outer skin and extending them between the first lateral side edge and the second lateral side edge of the outer skin. Portions of the bent outer skin abut portions of the bent at least one inner skin component. In one embodiment, the outer skin abuts with the at least one inner skin component in two different areas of contact.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

FIG. 6 is a bottom front perspective view of the assembly of FIG. 1.

FIG. 7 is a top rear perspective view of the assembly of FIG. 1.

FIG. 8 is a right side profile view of the assembly of FIG. 1.

FIG. 14 is a bottom front perspective view of the assembly of FIG. 9.

FIG. 15 is a top rear perspective view of the assembly of FIG. 9.

FIG. 16 is a right side profile view of the assembly of FIG. 9.

FIG. 22 is a bottom front perspective view of the assembly of FIG. 17.

FIG. 23 is a top rear perspective view of the assembly of FIG. 17.

FIG. 24 is a right side profile view of the assembly of FIG. 17.

DETAILED DESCRIPTION

Embodiments described herein include an assembly for a storage unit. One exemplary type of storage unit includes a gondola display fixture located in a retail store for displaying products or merchandise to customers for purchase. Another exemplary type of storage unit includes a shelving unit located in a distribution center or warehouse facility. Yet another exemplary type of storage unit includes an indoor or outdoor vending machine. More particularly, the assembly can be a reinforced base front that prevents damage to a base of a storage unit that can be caused by heavy machinery used in stocking the storage unit, such as fork lifts and the like.

The assembly is a front facing assembly located on a front of a storage unit and includes at least one inner skin component and an outer skin. The at least one inner skin or component has an upper mounting flange for mounting to the storage unit and, in some embodiments, a lower mounting flange for mounting to brackets of the storage unit. The outer skin directly attaches to and mates with an outer surface of the at least one inner skin or component to form the assembly.

Figure 1:
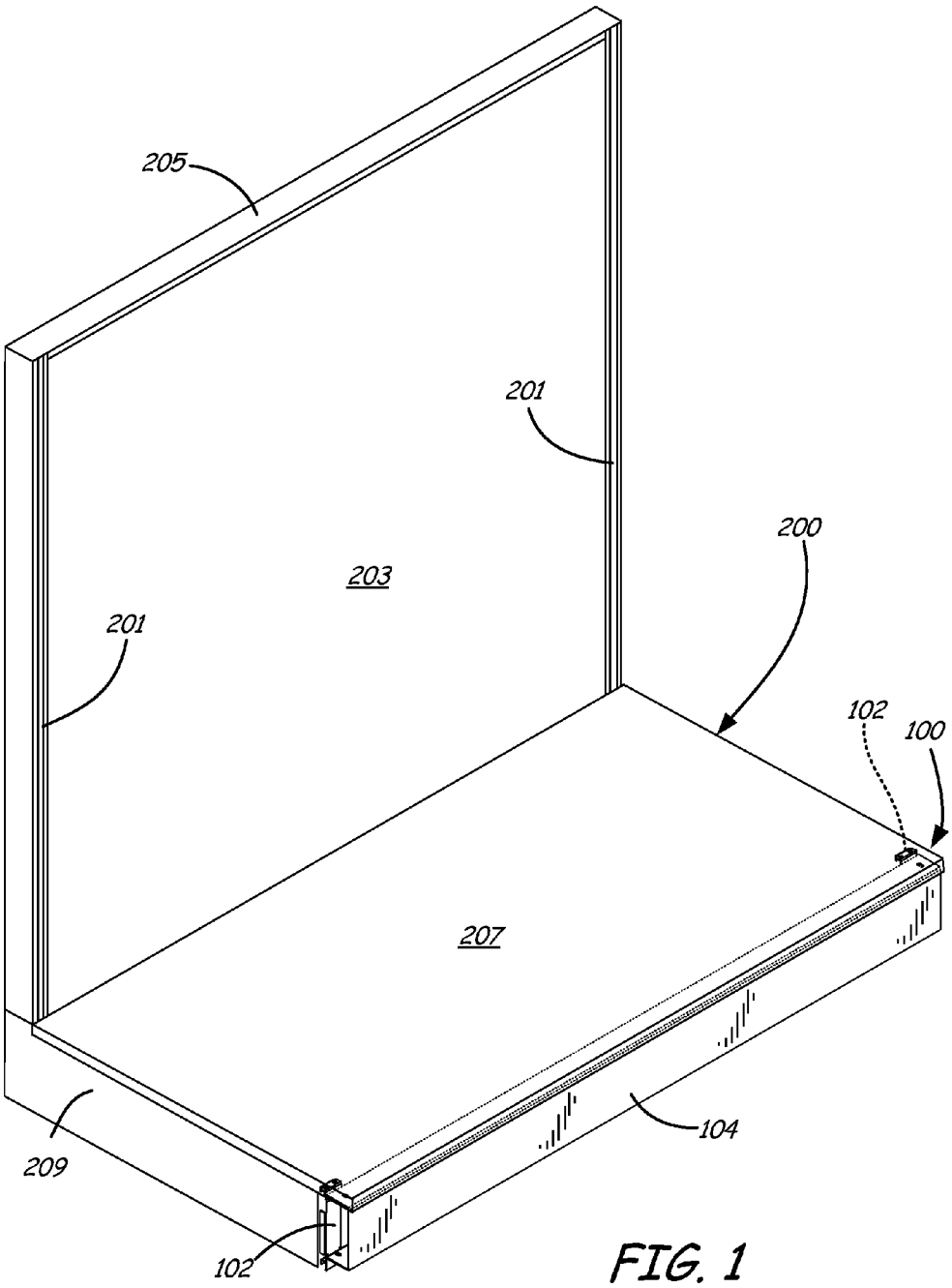
FIG. 1 is a top front perspective view of an assembly as coupled to a storage unit according to one embodiment.

FIG. 1 is a top front perspective view of an assembly 100 as coupled to a front of a storage unit 200 according to one embodiment. In FIG. 1, caps or end ramps covering the ends of the assembly 100 are removed for purposes of illustration. Storage unit 200 is an exemplary gondola display fixture as used in retail stores for holding products or merchandise for sale. These types of storage units can be wall mounted or free-standing. As illustrated in FIG. 1, exemplary storage unit 200 is configured to be wall mounted and includes a pair of uprights 201, a back panel 203, a top rail 205, a base deck 207 and base ends 209. Hidden from view are a pair of base brackets that along with the uprights 201 provide the main support structure for storage unit 200.

Assembly 100 closes off the bottom front of the storage unit 200 that is located below base deck 207 and between base ends 209. However, it should be realized that assembly 100 is not limited to being located at the base of a storage unit. In other embodiments, assembly 100 can be positioned anywhere along the front of the storage unit. Unlike conventional base fronts, which include only a single piece of material, assembly 100 is constructed of at least one inner skin component 102 made of a first piece of sheet material and an outer skin or exterior component 104 made of a second piece of sheet material. As illustrated, assembly 100 includes a pair of substantially identical interior components 102 each made of a first piece of sheet material.

Figure 2:
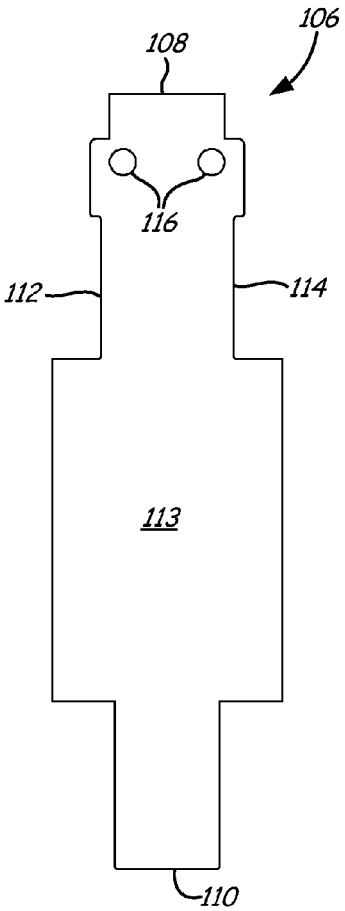
FIG. 2 is a plan view of a blank for one of the inner skin components of the assembly of FIG. 1.

FIG. 2 is a plan view of a blank or single, continuous piece of bendable sheet material 106, such as sheet metal, having a first surface or exterior facing surface 113 and an opposing second surface or interior facing surface 115 (FIG. 3) that is to be formed into one of the inner skin components 102 of assembly 100. Sheet material 106 includes an upper longitudinal edge 108, a lower longitudinal edge 110, a first lateral side edge 112 and a second lateral side edge 114. Sheet material 106 also includes an upper pair of apertures 116 located near upper longitudinal edge 108. Apertures 116 are for use in mounting assembly 100 to a storage unit, such as storage unit 200.

Figure 3:
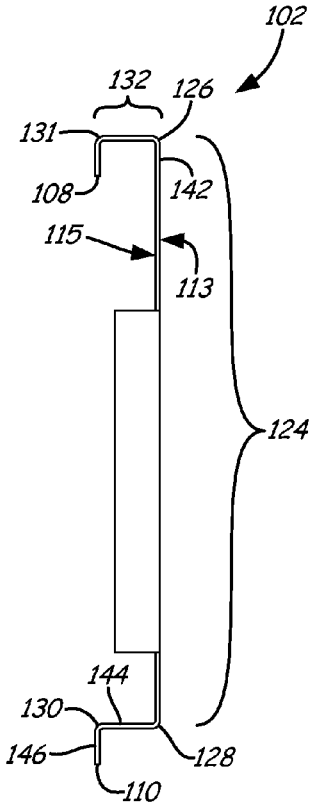
FIG. 3 is a left side profile view of the inner skin component after being formed from the blank illustrated in FIG. 2.

FIG. 3 is a left side profile view of one of the pair of inner skin components 102 after being formed from the blank or sheet material 106 illustrated in FIG. 2. To form inner skin component 102, a plurality of longitudinal bends are formed in sheet material 106 that extend from first lateral side edge 112 to second lateral side edge 114 and are located between upper longitudinal edge 108 and lower longitudinal edge 110. Each of the longitudinal bends provides sheet material with an approximate or substantially 90 degree bend.

To form a main body 124 of inner skin component 102, longitudinal bends 126, 128 and 130 are formed. To form an upper mounting flange 132 for mounting to a base deck, such as base deck 207, of a storage unit, such as storage unit 200, yet another bend 131 is formed. Upper mounting flange 132 is defined between longitudinal bend 126 and longitudinal bend 131.

Each of the pair of inner skin components 102 also includes a first vertical section or front facing upper panel 142, a lower horizontal section or lower panel 144 and a second vertical section or front facing lower panel 146. Lower horizontal section 144 is defined between longitudinal bend 128 and longitudinal bend 130. First vertical section 142 is substantially orthogonal to lower horizontal section 144, is defined between longitudinal bend 126 and longitudinal bend 128 and couples upper mounting flange 132 to lower horizontal section 144. Second vertical section 146 is substantially orthogonal to lower horizontal section 144 and is defined between lower longitudinal edge 110 and longitudinal bend 130.

Figure 4:
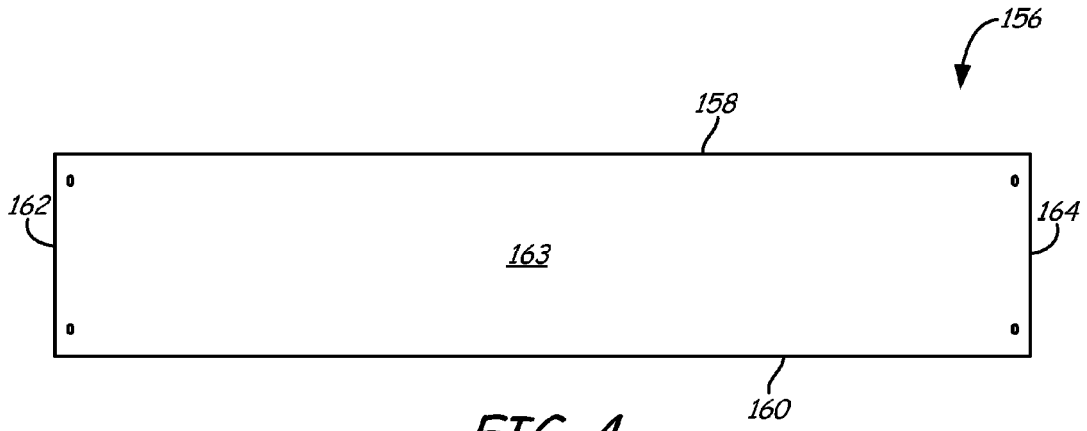
FIG. 4 is a plan view of a blank for the outer skin of the assembly of FIG. 1.

FIG. 4 is a plan view of a blank or single, continuous piece of bendable sheet material 156, such as sheet metal, having a first surface or exterior facing surface 163 and an opposing second surface or interior facing surface 165 (FIG. 5) that is to be formed into outer skin 104 of assembly 100. Sheet material 156 includes an upper longitudinal edge 158, a lower longitudinal edge 160, a first lateral side edge 162 and a second lateral side edge 164.

Figure 5:
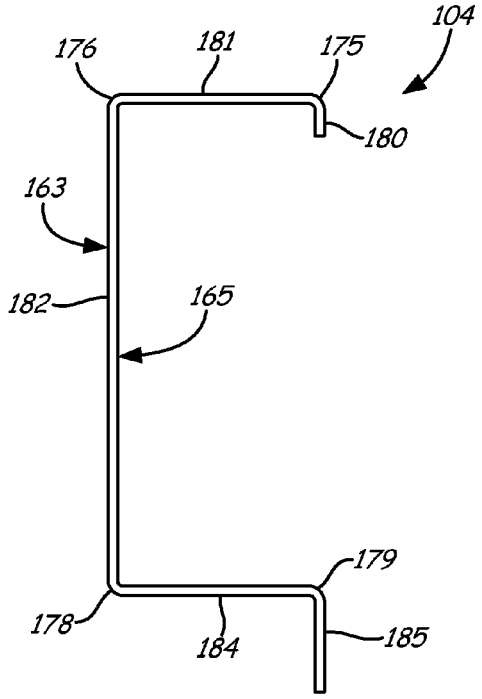
FIG. 5 is a left side profile view of an outer skin after being formed from the blank illustrated in FIG. 4.

FIG. 5 is a left side profile view of outer skin 104 after being formed from the blank or sheet material 156 illustrated in FIG. 4. To form outer skin 104, a plurality of longitudinal bends are formed in sheet material 156 that extend from first lateral side edge 162 to second lateral side edge 164 and are located between upper longitudinal edge 158 and lower longitudinal edge 160. Each of the longitudinal bends provides sheet material with an approximate or substantially 90 degree bend.

To form outer skin 104, longitudinal bends 175, 176, 178 and 179 are formed. Outer skin 104 includes a first vertical section or back facing panel 180, an upper horizontal section or upper panel 181, a second vertical section or front facing upper panel 182, a lower horizontal section or lower panel 184 and a third vertical section or front facing panel 185. Upper horizontal section 181 is defined between longitudinal bend 175 and longitudinal bend 176. Lower horizontal section 184 is defined between longitudinal bend 178 and longitudinal bend 179. First vertical section 180 is substantially orthogonal to upper and lower horizontal sections 181 and 184 and is defined between upper longitudinal edge 158 and longitudinal bend 175. Second vertical section 182 is substantially orthogonal to upper and lower horizontal sections 181 and 184 and is defined between longitudinal bend 176 and longitudinal bend 178. Second vertical section 182 couples upper and lower horizontal sections 181 and 184 together. Third vertical section 185 is substantially orthogonal to upper and lower horizontal sections 181 and 184 and is defined between longitudinal bend 179 and lower longitudinal edge 160.

FIGS. 6-8 illustrate the pair of interior components 102 and outer skin 104 assembled together to form assembly 100. In particular, FIG. 6 is a top front perspective view, FIG. 7 is a top rear perspective view and FIG. 8 is a right side profile view. In addition, FIGS. 6 and 7 illustrate only partial views of outer skin 104. In particular, inner lengths of outer skin 104 are removed as denoted by the broken lines to simplify the views. As illustrated, the pair of components 102 and outer skin 104 interface or mate together so that portions of outer skin 104 directly attach and abut to portions of interior components 102. Exemplary ways of attaching outer skin 104 to interior components 102 include welding, such as spot welding, using fasteners and the like.

As illustrated in FIGS. 6-8, outer skin 104 directly attaches to each of interior components 102 at two areas of contact. In particular, a first area of contact includes first surface 163 along first vertical section 180 of outer skin 104 abutting a portion of first surface 113 along first vertical section 142 of each interior component 102. A second area of contact includes first surface 163 along a portion of third vertical section 185 of outer skin 104 abutting a first surface 113 along first vertical section 142 of each interior component 102. Outer skin 104 may be mounted, attached, welded or otherwise fixedly abutted to interior components 102 at areas along any or all of the areas of contact. As illustrated in FIG. 8, these three areas of contact are made possible by the varying shapes of the two different sheet materials 106 and 156.

After outer skin 104 is mounted, attached, welded or otherwise fixedly abutted to each of interior components 102 to form assembly 100, assembly 100 is then mounted to a storage unit, such as storage unit 200. For example, fasteners (not shown) can be inserted through the upper pair of apertures 116 to couple to a base deck, such as base deck 207, of the storage unit.

Figure 9:
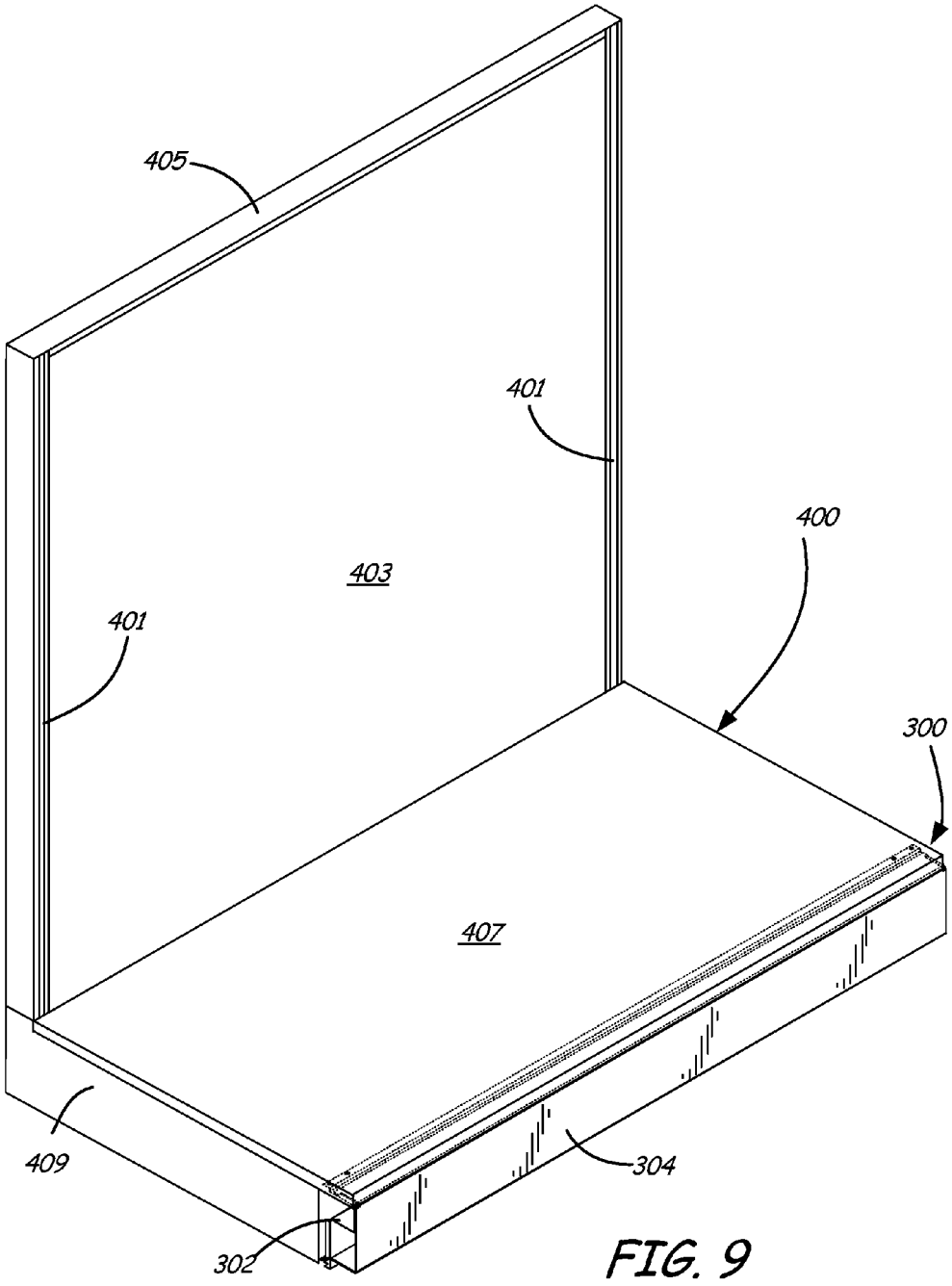
FIG. 9 is a top front perspective view of an assembly as coupled to a storage unit according to one embodiment.

FIG. 9 is a top front perspective view of an assembly 300 as coupled to a front of a storage unit 400 according to another embodiment. In FIG. 9, caps or end ramps covering the ends of the assembly 300 are removed for purposes of illustration. Storage unit 400 is an exemplary gondola display fixture as used in retail stores for holding products or merchandise for sale. These types of storage units can be wall mounted or free-standing. As illustrated in FIG. 9, exemplary storage unit 400 is configured to be wall mounted and includes a pair of uprights 401, a back panel 403, a top rail 405, a base deck 407 and base ends 409. Hidden from view are a pair of base brackets that along with the uprights 401 provide the main support structure for storage unit 400.

Assembly 300 closes off the bottom front of the storage unit 400 that is located below base deck 407 and between base ends 409. However, it should be realized that assembly 300 is not limited to being located at the base of a storage unit. In other embodiments, assembly 300 can be positioned anywhere along the front of the storage unit. Unlike conventional base fronts, which include only a single piece of material, assembly 300 is constructed of a two-part assembly including an inner skin or interior component 302 made of a first piece of sheet material and an outer skin or exterior component 304 made of a second piece of sheet material.

Figure 10:
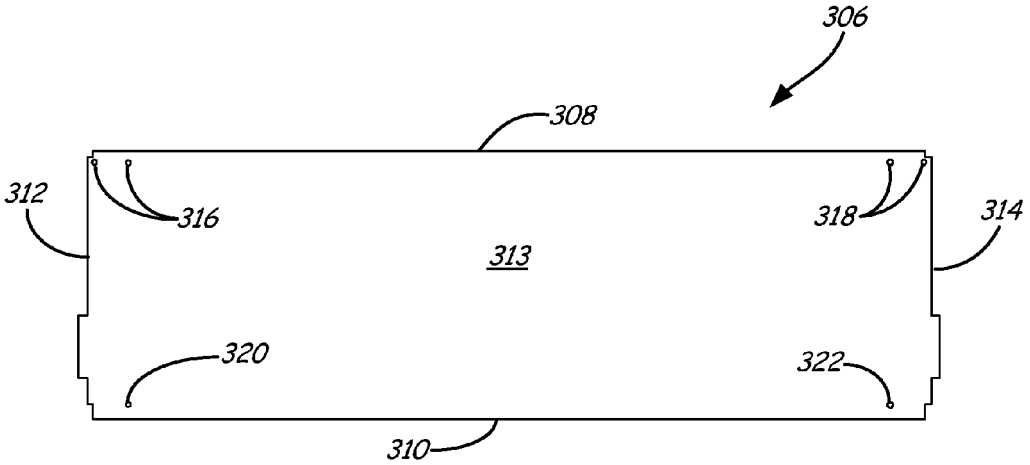
FIG. 10 is a plan view of a blank for an inner skin of the assembly of FIG. 9.

FIG. 10 is a plan view of a blank or single, continuous piece of bendable sheet material 306, such as sheet metal, having a first surface or exterior facing surface 313 and an opposing second surface or interior facing surface 315 (FIG. 11) that can be formed into inner skin 302 of assembly 300. Sheet material 306 includes an upper longitudinal edge 308, a lower longitudinal edge 310, a first lateral side edge 312 and a second lateral side edge 314. Sheet material 306 also includes an upper first pair of apertures 316 located near the intersecting corner of upper longitudinal edge 308 and first lateral side edge 312 and an upper second pair of apertures 318 located near the intersecting corner of upper longitudinal edge 308 and second lateral side edge 314. Sheet material 106 also includes a lower first aperture 320 located near the intersecting corner of lower longitudinal edge 310 and first lateral side edge 312 and a lower second aperture 322 located near the intersecting corner of lower longitudinal edge 310 and second lateral side edge 314. Apertures 316, 318, 320 and 322 are for use in mounting assembly 300 to a storage unit, such as storage unit 400.

Figure 11:
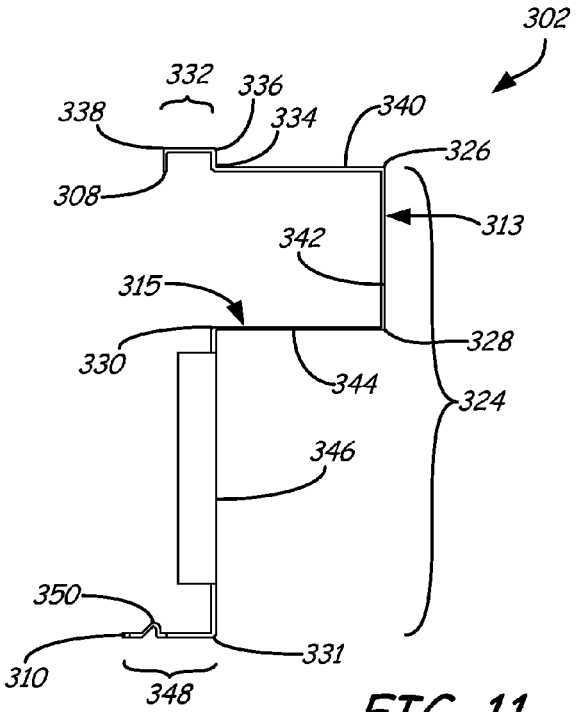
FIG. 11 is a left side profile view of the inner skin after being formed from the blank illustrated in FIG. 10.

FIG. 11 is a left side profile view of inner skin 302 after being formed from the blank or sheet material 306 illustrated in FIG. 10. To form inner skin 302, a plurality of longitudinal bends are formed in sheet material 306 that extend from first lateral side edge 312 to second lateral side edge 314 and are located between upper longitudinal edge 308 and lower longitudinal edge 310. Each of the longitudinal bends provides sheet material with an approximate or substantially 90 degree bend.

To form a main body 324 of inner skin 302, longitudinal bends 326, 328, 330 and 331 are formed. To form an upper mounting flange 332 for mounting to a base deck, such as base deck 407, of a storage unit, such as storage unit 400, longitudinal bends 334, 336 and 338 are formed. Upper mounting flange 332 is defined between upper longitudinal edge 308 and longitudinal bend 334 and encompasses longitudinal bend 336 and longitudinal bend 338.

Inner skin 302 also includes an upper horizontal section or upper panel 340, a first vertical section or front facing upper panel 342, a lower horizontal section or lower panel 344, a second vertical section or front facing lower panel 346 and a lower mounting flange or lower mounting panel 348. Upper horizontal section 340 is defined between longitudinal bend 326 and the upper mounting flange 332 or longitudinal bend 334. Lower horizontal section 344 is defined between longitudinal bend 328 and longitudinal bend 330. First vertical section 342 is substantially orthogonal to upper and lower horizontal sections 340 and 344, is defined between longitudinal bend 326 and longitudinal bend 328 and couples upper and lower horizontal sections 340 and 344 together. Second vertical section 346 is substantially orthogonal to upper and lower horizontal sections 340 and 344 and is defined between longitudinal bend 330 and longitudinal bend 331. Lower mounting flange 348 is configured to mount to base brackets of a storage unit, such as storage unit 400, and is defined between lower longitudinal edge 310 and longitudinal bend 331 and is oriented substantially orthogonal to second vertical section 346 except for two small notches 350 and 351 (FIGS. 11 and 15) that do not extend from first lateral side edge 312 to second lateral side edge 314. Notches 350 and 351 are bent at an approximate 45 degree angle relative to lower mounting flange 348.

Figure 12:
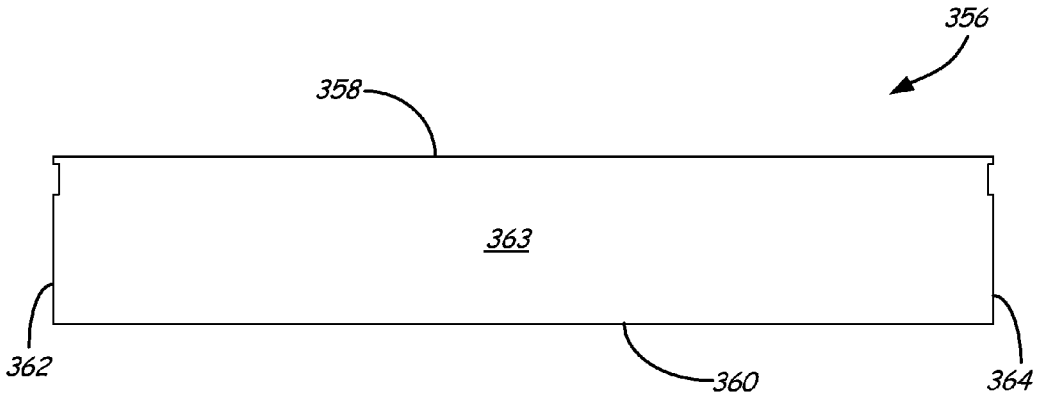
FIG. 12 is a plan view of a blank for the outer skin of the assembly of FIG. 9.

FIG. 12 is a plan view of a blank or single, continuous piece of bendable sheet material 356, such as sheet metal, having a first surface or exterior facing surface 1363 and an opposing second surface or interior facing surface 365 (FIG. 13) that can be formed into outer skin 304 of assembly 300. Sheet material 356 includes an upper longitudinal edge 358, a lower longitudinal edge 360, a first lateral side edge 362 and a second lateral side edge 364.

Figure 13:
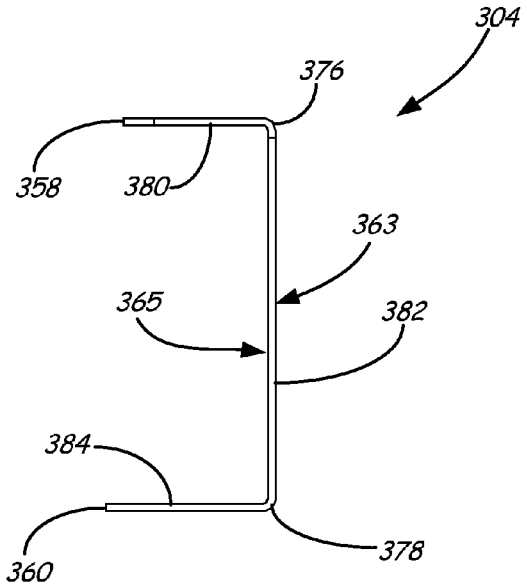
FIG. 13 is a left side profile view of an outer skin after being formed from the blank illustrated in FIG. 12.

FIG. 13 is a left side profile view of outer skin 304 after being formed from the blank or sheet material 356 illustrated in FIG. 12. To form outer skin 304, a plurality of longitudinal bends are formed in sheet material 356 that extend from first lateral side edge 362 to second lateral side edge 364 and are located between upper longitudinal edge 358 and lower longitudinal edge 360. Each of the longitudinal bends provides sheet material with an approximate or substantially 90 degree bend.

To form outer skin 304, longitudinal bends 376 and 378 are formed. Outer skin 304 includes an upper horizontal section or upper panel 380, a first vertical section or front facing upper panel 382 and a lower horizontal section or lower panel 384. Upper horizontal section 380 is defined between longitudinal bend 376 and upper longitudinal edge 358. Lower horizontal section 384 is defined between longitudinal bend 378 and lower longitudinal edge 360. First vertical section 382 is substantially orthogonal to upper and lower horizontal sections 380 and 384, is defined between longitudinal bend 376 and longitudinal bend 378 and couples upper and lower horizontal sections 380 and 384 together.

FIGS. 14-16 illustrate inner skin 302 and outer skin 304 assembled together to form assembly 300. In particular, FIG. 14 is a bottom front perspective view, FIG. 15 is a top rear perspective view and FIG. 16 is a right side profile view. In addition, FIGS. 14 and 15 are partial views of inner skin 302 and outer skin 304. In particular, inner lengths of inner skin 302 and outer skin 304 are removed as denoted by the broken lines to simplify the views. As illustrated, inner skin 302 and outer skin 304 interface or mate together so that portions of second surface 365 of outer skin 304 directly attach and abut to portions of first surface 313 of inner skin 302. Exemplary ways of attaching outer skin 304 to inner skin 302 include welding, such as spot welding, using fasteners and the like.

As illustrated in FIGS. 14-16, outer skin 304 directly attaches to inner skin 302 at three areas of contact. In particular, a first area of contact includes second surface 365 along upper horizontal section 380 of outer skin 304 abutting a portion of first surface 313 along upper horizontal section 340 of inner skin 302. A second area of contact includes second surface 365 along a portion of first vertical section 382 of outer skin 304 abutting a first surface 313 along first vertical section 342 of inner skin 302. A third area of contact includes lower longitudinal edge 360 of outer skin 304 abutting a portion of first surface 313 along second vertical section 346 of inner skin 302. Outer skin 304 may be mounted, attached, welded or otherwise fixedly abutted to inner skin 302 at areas along any or all of the areas of contact. As illustrated in FIG. 16, these three areas of contact are made possible by the varying shapes of the two different sheet materials 306 and 356. In particular, the fact that a distance 390 between first horizontal section 340 and second horizontal section 344 of inner skin 302 is less than a distance 392 between first horizontal section 380 and second horizontal section 384 of outer skin 304 provides for less than full sections between longitudinal bends of inner skin 302 and outer skin 304 to contact each other.

After outer skin 304 is mounted, attached, welded or otherwise fixedly abutted to inner skin 302 to form assembly 300, assembly 300 is then mounted to a storage unit, such as storage unit 400. For example, fasteners (not shown) can be inserted through the upper first pair of apertures 316 and the upper second pair of apertures 318 to couple to a base deck, such as base deck 407, of the storage unit and fasteners (not shown) can be inserted through lower first aperture 320 and lower second aperture 322 to couple to base brackets of the storage unit. In addition, notches 350 and 351 can be configured to mate with the base brackets.

Figure 17:
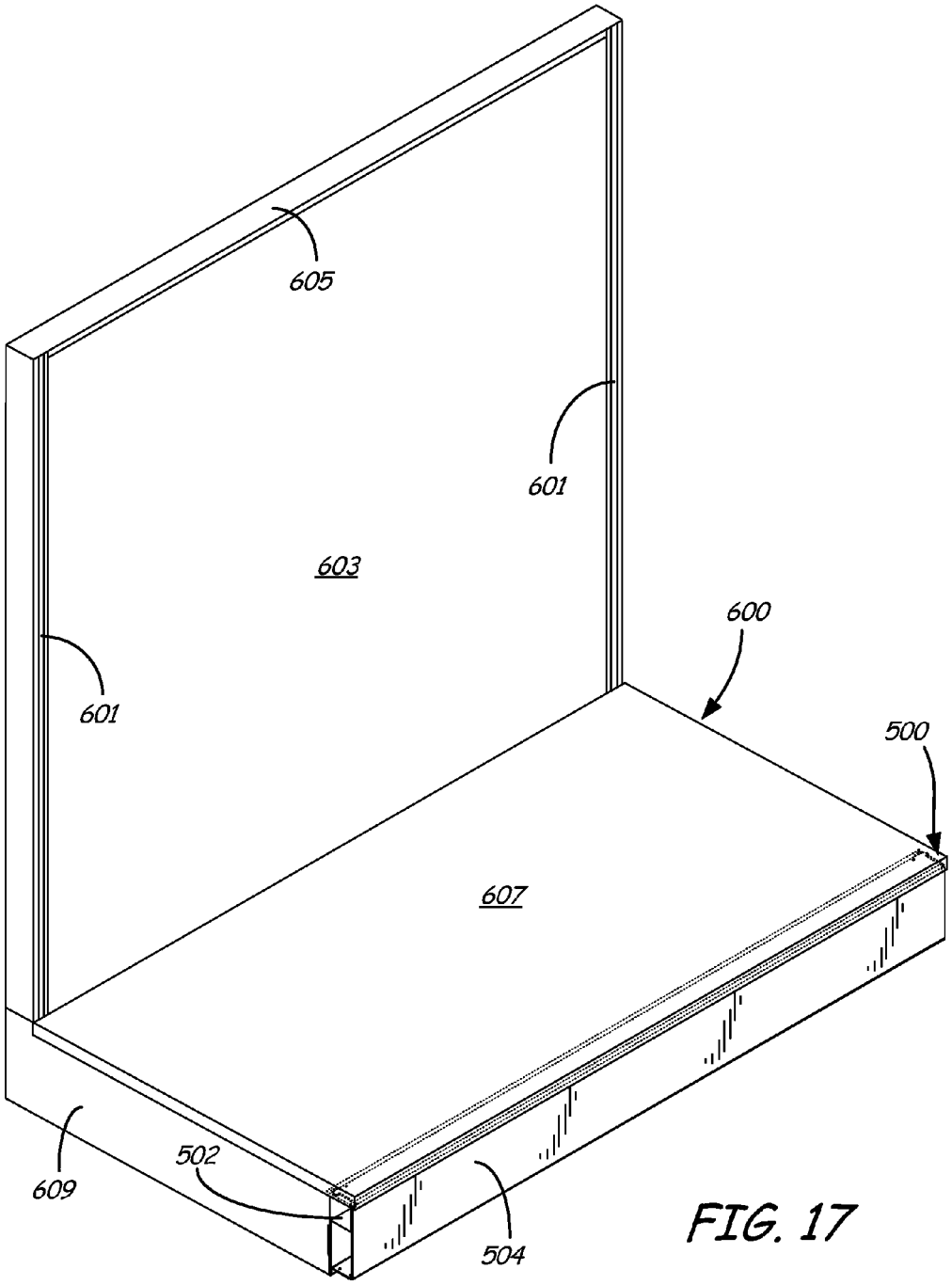
FIG. 17 is a top front perspective view of an assembly as coupled to a storage unit according to another embodiment.

FIG. 17 is a top front perspective view of an assembly 500 as coupled to a front of a storage unit 600, such as a gondola display fixture, according to yet another embodiment. In FIG. 9, caps covering the ends of assembly 500 are removed for purposes of illustration. As illustrated in FIG. 9, storage unit 600 is configured to be wall mounted and includes a pair of uprights 601, a back panel 603, a top rail 605, a base deck 607 and base ends 609. Hidden from view are a pair of base brackets that along with the uprights 601 provide the main support structure for storage unit 600.

Assembly 500 closes off the bottom front of the storage unit 600 that is located below base deck 607 and between base ends 609. As is assembly 300 of FIG. 9, assembly 500 is constructed of two-parts including an inner skin or interior component 502 made of a first piece of sheet material and an outer skin or exterior component 504 made of a second piece of sheet material.

Figure 18:
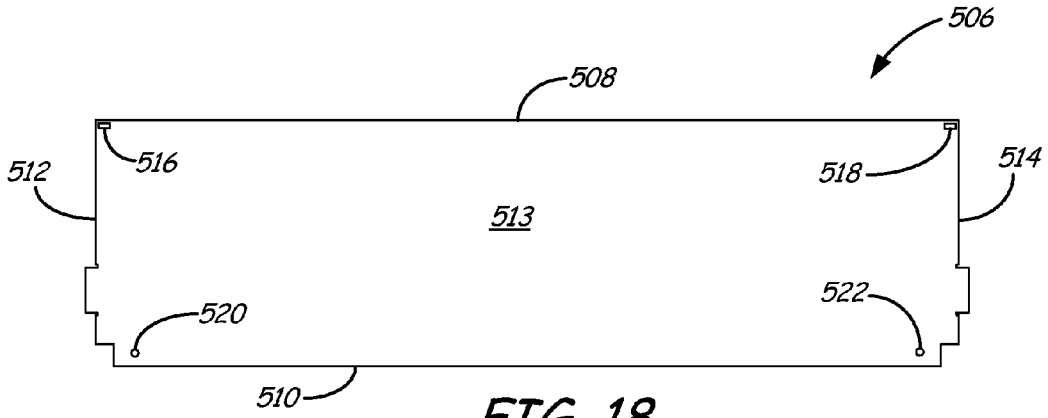
FIG. 18 is a plan view of a blank for an inner skin of the assembly of FIG. 17.

FIG. 18 is a plan view of a blank or single, continuous piece of bendable sheet material 506, such as sheet metal, having a first surface or exterior facing surface 513 and an opposing second surface or interior facing surface 515 (FIG. 19) that can be formed into inner skin 502 of assembly 500. Sheet material 506 includes an upper longitudinal edge 508, a lower longitudinal edge 510, a first lateral side edge 512 and a second lateral side edge 514. Sheet material 506 also includes a first upper slot 516 located near the intersecting corner of upper longitudinal edge 508 and first lateral side edge 512 and a second upper slot 518 located near the intersecting corner of upper longitudinal edge 508 and second lateral side edge 514. Sheet material 506 also includes a lower first aperture 520 located near the intersecting corner of lower longitudinal edge 510 and first lateral side edge 512 and a lower second aperture 522 located near the intersecting corner of lower longitudinal edge 510 and second lateral side edge 514. Slots 516 and 518 and apertures 520 and 522 are for use in mounting assembly 500 to a storage unit, such as storage unit 600.

Figure 19:
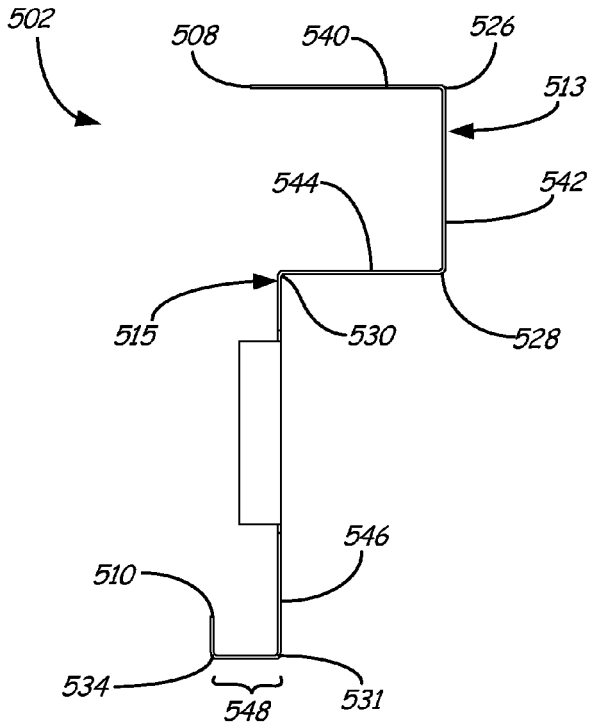
FIG. 19 is a left side profile view of the inner skin after being formed from the blank illustrated in FIG. 18.

FIG. 19 is a left side profile view of inner skin 502 after being formed from the blank or sheet material 506 illustrated in FIG. 18. To form inner skin 502, a plurality of longitudinal bends are formed in sheet material 506 that extend from first lateral side edge 512 to second lateral side edge 514 and are located between upper longitudinal edge 508 and lower longitudinal edge 510. Each of the longitudinal bends provides sheet material with an approximate or substantially 90 degree bend.

To form inner skin 502, longitudinal bends 526, 528, 530, 531 and 534 are formed. Inner skin 502 includes an upper horizontal section, upper panel or upper mounting flange 540, a first vertical section or front facing upper panel 542, a lower horizontal section or lower panel 544, a second vertical section or front facing lower panel 546 and a lower mounting flange or lower mounting panel 548. Upper horizontal section 540 is defined between longitudinal bend 526 and upper longitudinal edge 508. Lower horizontal section 544 is defined between longitudinal bend 528 and longitudinal bend 530. First vertical section 542 is substantially orthogonal to upper and lower horizontal sections 540 and 544, is defined between longitudinal bend 526 and longitudinal bend 528 and couples upper and lower horizontal sections 540 and 544 together. Second vertical section 546 is substantially orthogonal to upper and lower horizontal sections 540 and 544 and is defined between longitudinal bend 530 and longitudinal bend 531. Lower mounting flange 548 is configured to mount to base brackets of a storage unit, such as storage unit 400, and is defined between lower longitudinal edge 510 and longitudinal bend 531 and includes longitudinal bend 534.

Figure 20:
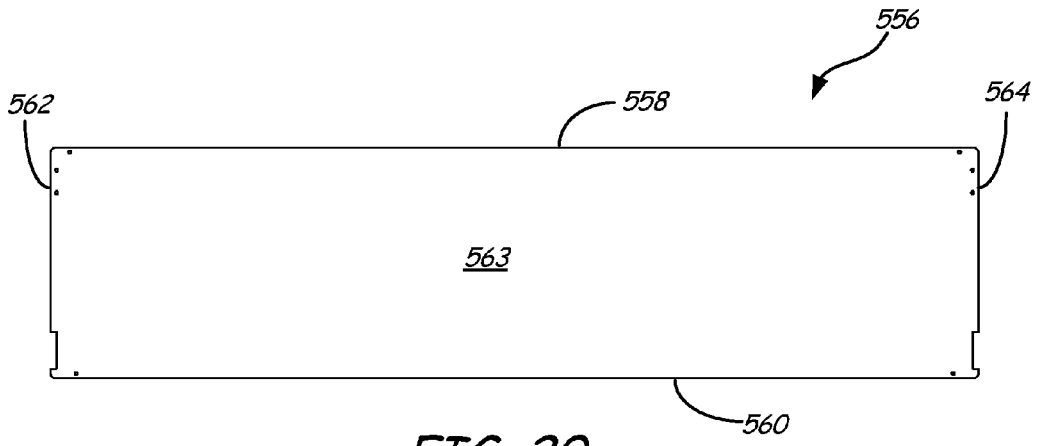
FIG. 20 is a plan view of a blank for an outer skin of the assembly of FIG. 17.

FIG. 20 is a plan view of a blank or single, continuous piece of bendable sheet material 556, such as sheet metal, having a first surface or exterior facing surface 563 and an opposing second surface or interior facing surface 565 (FIG. 21) that can be formed into outer skin 504 of assembly 500. Sheet material 556 includes an upper longitudinal edge 558, a lower longitudinal edge 560, a first lateral side edge 562 and a second lateral side edge 564.

Figure 21:
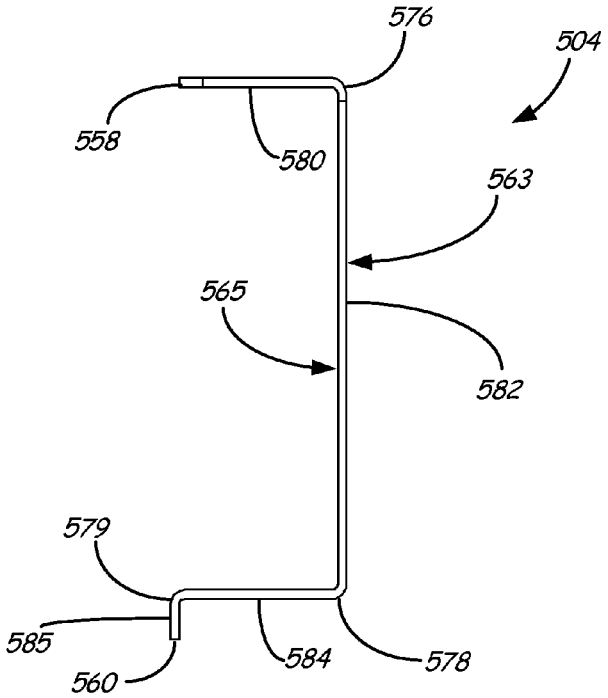
FIG. 21 is a left side profile view of the outer skin after being formed from the blank illustrated in FIG. 20.

FIG. 21 is a profile view of outer skin 504 after being formed from the blank or sheet material 556 illustrated in FIG. 20. To form outer skin 504, a plurality of longitudinal bends are formed in sheet material 556 that extend from first lateral side edge 562 to second lateral side edge 564 and are located between upper longitudinal edge 558 and lower longitudinal edge 560. Each of the longitudinal bends provides sheet material with an approximate or substantially 90 degree bend.

To form outer skin 504, longitudinal bends 576, 578 and 579 are formed. Outer skin 504 includes an upper horizontal section or upper panel 580, a first vertical section or first front facing upper panel 582, a lower horizontal section or lower panel 584 and a second vertical section or second front facing panel 585. Upper horizontal section 580 is defined between longitudinal bend 576 and upper longitudinal edge 558. Lower horizontal section 584 is defined between longitudinal bend 578 and longitudinal bend 579. First vertical section 582 is substantially orthogonal to upper and lower horizontal sections 580 and 584, is defined between longitudinal bend 576 and longitudinal bend 578 and couples upper and lower horizontal sections 580 and 584 together. Second vertical section 585 is substantially orthogonal to upper and lower horizontal sections 580 and 584 and is defined between longitudinal bend 579 and lower longitudinal edge 560.

FIGS. 22-24 illustrate inner skin 502 and outer skin 504 assembled together to form assembly 500. In particular, FIG. 22 is a bottom front perspective view, FIG. 23 is a top rear perspective view and FIG. 24 is a right side profile view. In addition, FIGS. 22 and 23 are partial views of inner skin 502 and outer skin 504. In particular, inner lengths of inner skin 502 and outer skin 504 are removed as denoted by the broken lines to simplify the views. As illustrated, inner skin 502 and outer skin 504 interface or mate together so that portions of second surface 565 of outer skin 504 directly attach and abut to portions of first surface 513 of inner skin 502. Exemplary ways of attaching outer skin 504 to inner skin 502 include welding, such as spot welding, using fasteners and the like.

As illustrated in FIGS. 22-24, outer skin 504 directly attaches to inner skin 502 at three areas of contact. In particular, a first area of contact includes second surface 565 along upper horizontal section 580 of outer skin 504 abutting a portion of first surface 513 along upper horizontal section 540 of inner skin 502. A second area of contact includes second surface 565 along a portion of first vertical section 582 of outer skin 504 abutting a first surface 513 along first vertical section 542 of inner skin 502. A third area of contact includes second surface 565 along second vertical section 585 of outer skin 504 abutting a portion of first surface 513 along second vertical section 546 of inner skin 502. As illustrated in FIG. 24, these three areas of contact are made possible by varying shapes of the two different sheet materials 506 and 556. Outer skin 504 may be mounted, attached, welded or otherwise fixedly abutted to inner skin 104 at points along any or all of the areas of contact. In particular, the fact that a distance 590 between first horizontal section 540 and second horizontal section 544 of inner skin 502 is less than a distance 592 between first horizontal section 580 and second horizontal section 584 of outer skin 504 provides for less than full sections between longitudinal bends of inner skin 502 and outer skin 504 to contact each other.

After outer skin 504 is mounted, attached, welded or otherwise fixedly abutted to inner skin 502 to form assembly 500, assembly 500 is then mounted to a storage unit, such as storage unit 400. For example, fasteners (not shown) can be inserted through the upper slots 516 and 518 to couple to a base deck, such as base deck 607, of the storage unit and fasteners (not shown) can be inserted through lower apertures 520 and 522 to couple to base brackets of the storage unit.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A kick plate assembly mounted to a base front of a gondola display storage unit, wherein the base front of the gondola display includes a height, a width and a length, the kick plate assembly comprising:

at least two spaced apart inner skin components, wherein each inner skin component is made of a first single piece of bendable sheet material and including an upper longitudinal edge at one end of the first sheet, a lower longitudinal edge at an opposite end of the first sheet, a first lateral side edge and an opposing second lateral side edge, wherein between the upper longitudinal edge and the lower longitudinal edge of each inner skin component are a plurality of longitudinal bends extending from the first lateral side edge to the second lateral side edge and defining a plurality of substantially vertical panels comprising an upper substantially vertical panel, a lower substantially vertical panel, and at least one mid-section substantially vertical panel located above the lower substantially vertical panel, the lower substantially vertical panel extends downwardly relative to the at least one mid-section substantially vertical panel and ends at the lower longitudinal edge of the first sheet, a spacing is located between the upper substantially vertical panel and the lower substantially vertical panel along a vertical axis, wherein each inner skin component is mounted directly to a front portion of the base front of the gondola display; and an outer skin component made of a second single piece of bendable sheet material and including an upper longitudinal edge at one end of the second sheet, a lower longitudinal edge at an opposite end of the second sheet, a first lateral side edge and an opposing second lateral side edge, wherein between the upper longitudinal edge and the lower longitudinal edge of the outer skin are a plurality of longitudinal bends extending from the first lateral side edge to the second lateral side edge and defining a plurality of substantially vertical panels wherein the outer skin component has a height and a width that substantially covers the base front of the gondola display; and wherein portions of at least two of the plurality of substantially vertical panels of the outer skin component directly abut and attach to portions of at least one of the plurality of substantially vertical panels of the inner skin components.

2. The kick plate assembly of claim 1, wherein one of said plurality of substantially vertical panels of the outer skin component is a front facing upper panel.

3. The kick plate assembly of claim 2, wherein the plurality of longitudinal bends in each of the inner skin components comprises at least four longitudinal bends.

4. The kick plate assembly of claim 3, wherein defined between a first longitudinal bend in each of the inner skin components and a second longitudinal bend in each of the inner skin components is a upper substantially horizontal mounting panel, wherein defined between a third longitudinal bend in each of the inner skin components and the second longitudinal bend in each of the inner skin components is the at least one mid-section substantially vertical panel and wherein defined between the third longitudinal bend in each of the inner skin components and a fourth longitudinal bend in each of the inner skin components is a lower substantially horizontal panel.

5. The kick plate assembly of claim 4, wherein the plurality of longitudinal bends in the outer skin component comprises at least a first longitudinal bend, a second longitudinal bend and a third longitudinal bend.

6. The kick plate assembly of claim 5, wherein defined between the upper longitudinal edge of the outer skin component and the first longitudinal bend of the outer skin component is a back facing panel, wherein defined between the first longitudinal bend of the outer skin component and the second longitudinal bend of the outer skin component is an upper substantially horizontal panel and wherein defined between the second longitudinal bend of the outer skin component and the third longitudinal bend of the outer skin component is the front facing upper panel, wherein the back facing panel and the front facing panel comprise two of the plurality of substantially vertical panels of the outer skin component.

7. The kick plate assembly of claim 6, wherein the back facing panel of the outer skin component abuts a portion of the at least one mid-section substantially vertical panel of each inner skin component.

8. The kick plate assembly of claim 7, wherein defined between the third longitudinal bend of the outer skin component and a fourth longitudinal bend of the outer skin component is a lower substantially horizontal panel and wherein defined between the fourth longitudinal bend of the outer skin component and the lower longitudinal edge of the outer skin component is a front facing lower panel, wherein the front facing lower panel comprises one of the plurality of substantially vertical panels of the outer skin component.

9. The kick plate assembly of claim 8, wherein a portion of the front facing lower panel of the outer skin component abuts the at least one mid-section substantially vertical panel of each inner skin component.

10. A kick plate assembly mounted to a base front of a gondola display storage unit, wherein the base front of the gondola display includes a height, a width and a length, the kick plate assembly comprising:

at least two spaced apart interior components, wherein each interior component is made of a first single, continuous piece of sheet material and having a first surface, an opposing second surface, a pair of opposing lateral side edges and a plurality of substantially 90 degree longitudinal bends that extend between the pair of lateral side edges, each interior component including an upper substantially vertical panel at a first distal end of the first sheet, an upper substantially horizontal mounting flange extending from the upper substantially vertical panel, at least one mid-section panel extending downwardly from the upper horizontal mounting flange, and a lower substantially vertical panel extending downwardly from the at least one mid-section panel to an opposite distal end of each first sheet, the upper substantially vertical panel, the upper substantially horizontal mounting flange, the at least one mid-section panel, and the lower substantially vertical panel are each defined by corresponding bends of the plurality of substantially 90 degree longitudinal bends, wherein the interior components are each mounted directly to a front portion of the base front of the gondola display; and an exterior component made of a second single, continuous piece of sheet material and having a first surface and an opposing second surface, a pair of_opposing lateral side edges and a plurality of substantially 90 degree bends that extend between the pair of opposing lateral side edges of the exterior component and define the exterior component into at least an upper substantially horizontal section, a lower substantially horizontal section and a first substantially vertical section oriented substantially orthogonal to the upper substantially horizontal section and the lower substantially horizontal section and coupling the upper substantially horizontal section to the lower substantially horizontal section; and wherein the exterior component has a height and a width that substantially covers the base front of the gondola display;

wherein portions of the interior components are each directly attached to portions of the exterior component.

11. The kick plate assembly of claim 10, wherein each interior component is directly attached to the exterior component in at least two different areas of contact.

12. The kick plate assembly of claim 10, wherein the at least one mid-section panel of each interior component directly attaches to at least two substantially vertical sections of the exterior component.

13. The kick plate assembly of claim 12, wherein one of the substantially vertical sections of the exterior component further comprises a second substantially vertical section oriented substantially orthogonal to the upper substantially horizontal section and extends between the upper substantially horizontal section and an upper longitudinal edge of the exterior component.

14. The kick plate assembly of claim 12, wherein one of the substantially vertical sections of the exterior component further comprises a third substantially vertical section oriented substantially orthogonal to the lower horizontal section extending between the lower substantially horizontal section and a lower edge of the exterior component.

* * * * *